US006146179A

United States Patent [19]

Denny et al.

[11] Patent Number: 6,146,179

[45] Date of Patent: Nov. 14, 2000

[54] AUTO UNLATCHING CONNECTOR TAB

[75] Inventors: Ian McFarlane Denny, Greenock; Peter Andrew Smith, Ayrshire, both of United Kingdom

[73] Assignee: International Business Machines Corporation, Armonk, N.Y.

[21] Appl. No.: 09/356,983

[22] Filed: Jul. 19, 1999

[30] Foreign Application Priority Data

Dec. 9, 1998 [GB] United Kingdom ..... 9826915

[51] Int. Cl.[7] ..... H01R 13/627

[52] U.S. Cl. ..... 439/352; 439/350

[58] Field of Search ..... 439/350–358

[56] References Cited

U.S. PATENT DOCUMENTS

| | | | |
|---|---|---|---|
| 4,083,619 | 4/1978 | McCormick et al. | 439/352 |
| 5,314,347 | 5/1994 | Colleran et al. | 439/352 |
| 5,564,939 | 10/1996 | Maitani et al. | 439/352 |
| 5,580,182 | 12/1996 | Lin | 439/352 |
| 5,613,870 | 3/1997 | Traver, Jr. | 439/352 |
| 5,806,152 | 9/1998 | Saitou et al. | 439/352 |

FOREIGN PATENT DOCUMENTS

| | | | |
|---|---|---|---|
| 0 585 633 A1 | 3/1994 | European Pat. Off. | H01R 13/627 |
| WO 93/18559 | 9/1993 | WIPO | H01R 13/62 |

*Primary Examiner*—Hien Vu

*Attorney, Agent, or Firm*—Ratner & Prestia; Lawrence R. Fraley

[57] ABSTRACT

A first movable connector part and a second fixedly positioned connector part form a connector. The second fixedly positioned connector part has at least two catch members separately positioned at spaced apart locations. The first connector part is adapted to be moved in a first direction toward the second connector part in response to a predetermined insertion force until the first connector part and the second connector part are connected. The first connector part has at least two movable latches separately supported at spaced apart locations on the first connector part, each of the latches being associated with a respective one of the catch members. Each of the catch members are adapted for engaging a respective one of the movable latches. A flexible linking bar connects the movable latches. On application of a predetermined extraction force, the linking bar flexes so as to cause the movable latches to be released from the catch members.

15 Claims, 2 Drawing Sheets

AUTO UNLATCHING CONNECTOR TAB

FIELD OF THE INVENTION

The present invention relates to devices for connecting and disconnecting items such as cables from printed circuit cards and boards. More particularly, the present invention relates to connectors which include latches for retention of the connector in which the latches are easily released when desired.

BACKGROUND OF THE INVENTION

In practice, such connectors must be designed so that the contacts (which engage together to form the connection) do not become disconnected when subjected to different loads and stresses, such as those imposed by vibration, temperature differences and the like. In addition, the connector should be relatively easy to connect and disconnect.

To meet such requirements, connectors often include latches for connection and disconnection. Such latches ensure that mated contacts remain reliably closed and are prevented from opening during operation of the electronic assembly in which they are used.

In order to disconnect such a connector, the latches must be disengaged. Typically, this is achieved by means of pressing a pair of tabs on the latches at each end of the connector towards the center of the connector and then moving the connector so as to disconnect it. However, these tabs are usually small and may not be noticed by a person removing the connector. Excess force may be applied to the connector to remove it without first unlatching it. The tabs or latches may be damaged so that the connector does not latch properly when it is replaced. Alternatively, a person removing the connector may instead attempt to do so using the cable as a handle, thus risking damage to the cable's connections. Additionally, the requirement for two tabs to be pressed towards the center of the connector while simultaneously removing the connector means that removal of the connector may require two hands to perform the operation.

So it would be desirable to provide a connector which latched and unlatched automatically and could be connected and disconnected using one hand.

SUMMARY OF THE INVENTION

Accordingly, the present invention provides a first movable connector part for connection to and disconnection from a fixedly positioned second connector part having at least two catch members separately positioned at spaced apart locations on the second connector part, the first connector part being adapted for being moved in a first direction toward the second connector part in response to a predetermined insertion force until the first connector part and the second connector part are connected, the first connector part comprising: at least two movable latches separately supported at spaced apart locations on the first connector part, each of the latches being functionally associated with a respective one of the catch members, each of the catch members being adapted for engaging a respective one of the movable latches; and a flexible linking bar connecting the movable latches, the linking bar, on application of a predetermined extraction force, flexing so as to cause the movable latches to be released from the catch members.

The linking bar in its natural position forces the latches to be in an engaged position. The latches are flexible and may engage with the catch members, even when the latches are in an engaged position. The latches may not disengage from the catch members when they are in an engaged position. When a force is applied to the linking bar, it causes the movable latches to be released from the catch members. This has the advantage that a single action both releases the latches and removes the connector. This avoids damage to the latches by attempted extraction of the connector without first releasing the latches. Additionally, damage to the connecting cable is avoided, since it is less likely to be used as a handle to remove the connector. The connector may be removed more easily without prejudicing its security in normal operation.

In a preferred embodiment, the first movable connector part is adapted for mounting on a cable and the second fixedly positioned connector part is adapted for mounting on a printed circuit board.

Preferably, the first movable connector part further comprises a raised portion through which an insertion force applied to the linking bar during connection is applied to the first connector part.

In a first embodiment, the linking bar further comprises a handle. The presence of a handle that clearly protrudes from the connector indicates to a person intending to remove the connector that they should use the handle to remove the connector, rather than trying to remove it by pulling the cable.

In a second embodiment, the linking bar connects the latches in an arc.

The invention also provides a connector comprising a first movable connector part and a second fixedly positioned connector part having at least two catch members separately positioned at spaced apart locations on the second connector part.

BRIEF DESCRIPTION OF THE DRAWINGS

Embodiments of the invention will now be described, by way of example, with reference to the accompanying drawings, in which.

DETAILED DESCRIPTION OF THE INVENTION

Figure 1:
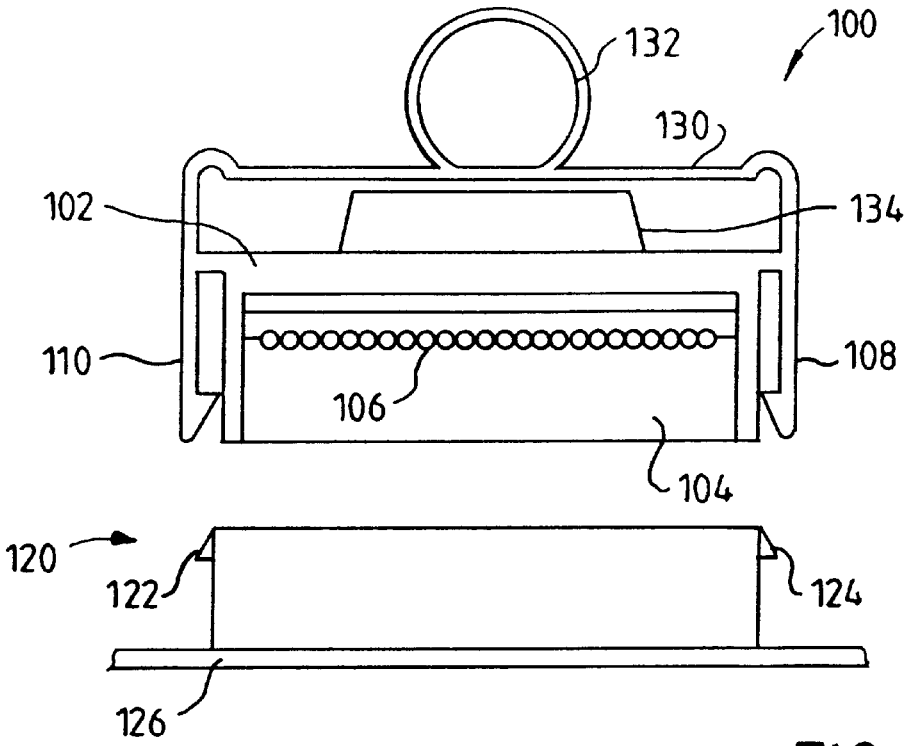
FIG. 1 shows a connector according to the present invention in an unlatched position.

FIG. 1 shows a connector according to the present invention in an unlatched position, together with the header onto which it is to be latched. The connector 100 has a main body 102 into which is placed a cable 106 and a securing member 104. The securing member 104 co-operates with the main body 102 in order to make a connection from the cable 106 to the contacts in the securing member 104. This assembly process is completed when the connector/cable assembly is manufactured. The securing member also acts as a strain relief for the cable, functioning to and prevent the cable from being detached from the connector in the event that the cable is subjected to a force, such as for example, if the cable is used to remove the connector.

Main body 102 also has movable latches 108, 110, which co-operate with catch members 122, 124 on the mating connector part 120 located on a printed circuit board 126.

The latches 108, 110 are shaped so that on insertion of the connector 100 onto the mating part 120, the latches 108, 110 slide over the catch members 122, 124 of the mating connector with a relatively low force so as to allow insertion of the connector 100 onto its mating part 120.

The main body 102 also has a linking bar 130 which links the two latches 108, 110 together. This linking bar 130 provides a force which tends to push the latches 108, 110 into a locked position. The linking bar also has a handle 132 attached to the surface of the linking bar 130 on the side facing away from the cable 106 and securing member 104.

Figure 2:
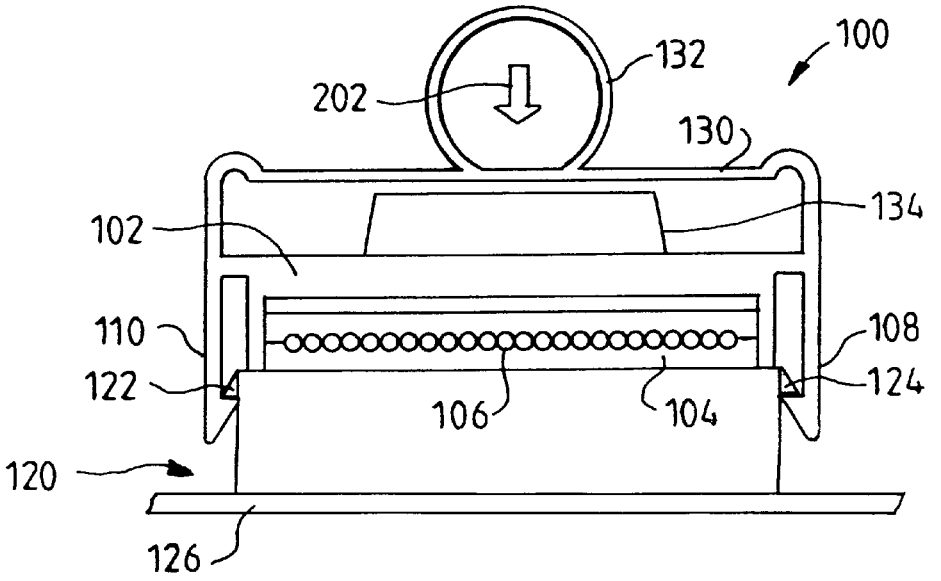
FIG. 2 shows the connector of FIG. 1 in a latched position.

Referring now to FIG. 2, in order to insert the connector 100 into the mating part 120, a force 202 is applied to the linking bar 130 and/or the handle 132 which are used to press the connector 100 onto the mating part 120. The latches 108, 110 are made of a flexible material which deforms slightly so as to allow the barbs on the latches 108, 110 to slide over the catch members 122, 124 on the mating part 120. The linking bar 130 provides a force to ensure that the latches 108, 110 return to a latched position after they have slid over the catch members 122, 124. The action of the catch members 122, 124 on the latches 108, 110 prevents the connector from becoming disconnected when subjected to different loads and stresses. The main body 102 optionally has a raised section 134 with which the linking bar 130 and handle 132 make contact when the connector 100 is being inserted so as to transfer the insertion force directly to the main body 102, rather than through the latch pivots. Raised section 134 also prevents over-flexing of the linking bar 130. The connector may optionally be used without a raised section 134, in which case the latches are likely to be caused to move outwards by the flexing of the linking bar 130, thus further assisting the insertion process.

Figure 3:
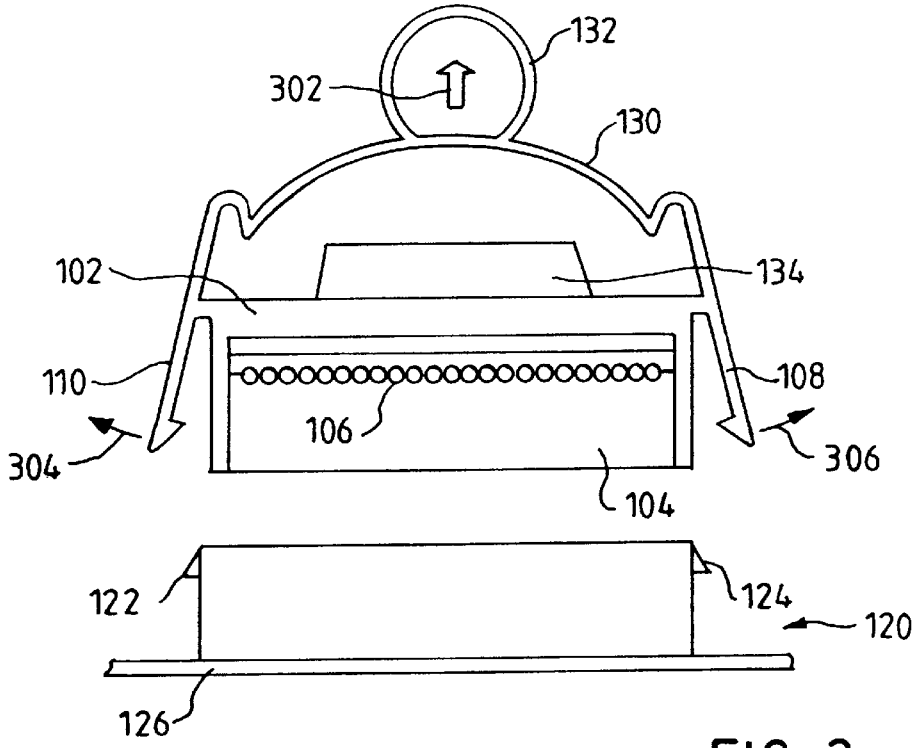
FIG. 3 shows the connector of FIG. 1 being unlatched.

FIG. 3 shows the connector 100 being removed from the mating part 120. A force 302 is applied to the handle 132 which acts to distort the linking bar 130. The distortion of the linking bar 130 acts to cause the latches 108, 110 to move outwards from the connector 100 main body 102. This motion causes the latches 108, 110 to release from the catch members 122, 124. The releasing of the latches 108, 110 from the catch members 122, 124 allows the connector 100 to be separated from the mating part 120. Thus the release of the latches 108, 110 and the removal of the connector 100 from the mating part 120 take place with a single pull operation. In the absence of a pull force on the handle 132 or the linking bar 130, the latches act to hold the connector 100 locked to the mating part 120.

The presence of an item (the handle 132) that clearly protrudes from the connector indicates to a person intending to remove the connector that they should use the handle 132 to remove the connector, rather than trying to remove it by pulling the cable. Additionally, the body of the connector, or just the handle itself, may be of a color which contrasts with the color of components in the equipment. For example, if the main body is made from molded plastic, then the molding may be colored. That color may be a bright color, such as the color yellow, so as to attract the eye's attention to the connector or it may be a color used to indicate user-removable parts, such as the color blue.

Figure 4:
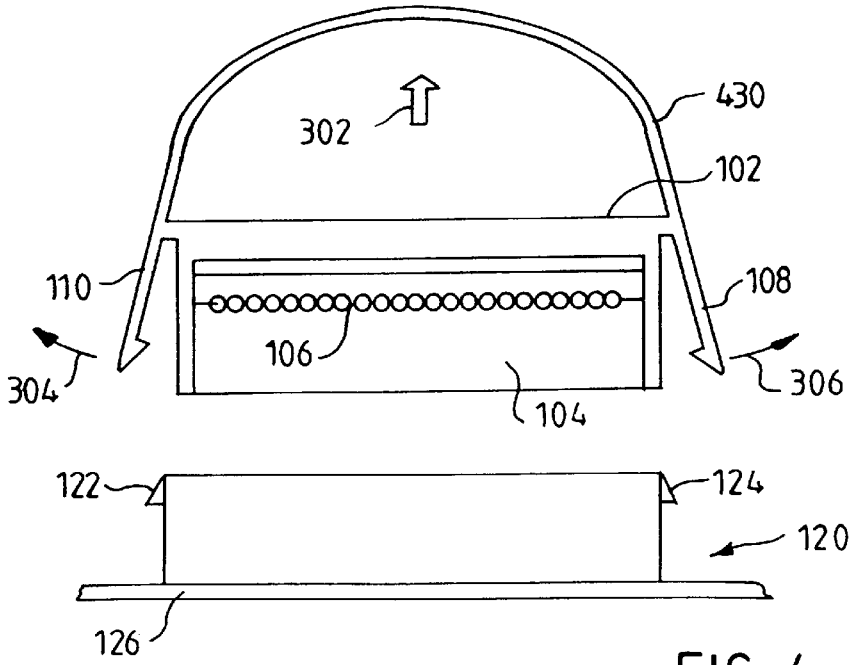
FIG. 4 shows a variation of the connector of FIG. 1 in which the linking bar is formed into an arc.

FIG. 4 shows a variation of the embodiment of FIG. 1 in which the linking bar 430 connects the upper ends of the latches 108, 110 in an arc. The linking bar 430 acts as a handle and so no separate handle 132 is necessary.

The present invention can be used to release latching catches used to hold processors or terminator cards from connectors such as those used by the Pentium II processor (Pentium is a trademark of Intel Corp.). It may further be used in any mechanical catch arrangement which has two or more catches located at either end of a device.

What is claimed is:

1. A latching mechanism for securing a first electrical connector part to a second electrical connector part, the latching mechanism comprising:

said first connector part having a body including a cable connection adapted for insertion in said second connector part, the first connector bode having a first and second sidewalls at least two spaced latches each extending along said sidewalls, each having a first end defining a barb and a second end, each latch pivotally mounted on the body of the first connector part at a point intermediate the first and second ends;

a flexible linking bar extending between the second ends of the latches;

at least two spaced catches on the second connector part, each catch shaped to engage in latching engagement one of the barbs on the first connector part when the first connector part is fully inserted in the second connector part; and a section extending from the first connector body toward the flexible linking bar, the section limiting deflection of the linking bar toward the first connector body wherein a force applied to the flexible linking bar on the first connector part in a direction away from the second connector part deforms the flexible linking bar, pivots the latches, displaces the barbs away from the catches, and disengages the latching engagement of the first and second connector parts.

2. The latching mechanism according to claim 1 wherein the latches are flexible.

3. The latching mechanism according to claim 2 wherein the flexible latches each comprise a short flexible tab, the tabs pivotally attaching the latches on the body of the first connector part.

4. The latching mechanism according to claim 1 wherein the first connector part is adapted to be mounted on a cable.

5. The latching mechanism according to claim 4 wherein the second connector part is adapted to be mounted on a printed circuit board.

6. The latching mechanism according to claim 1 wherein the flexible linking bar further comprises a handle.

7. The latching mechanism according to claim 1 wherein the linking bar connecting the latches is shaped as an arc bending away from the body of the first connector part.

8. An electrical connector assembly comprising:

a first connector part having:

(a) a body, including a cable connection for mounting a cable;

(b) at least two spaced latches each having a first end defining a barb and a second end, each latch pivotally mounted on the body at a point intermediate the first and second ends, and (c) a flexible linking bar extending between the second ends of the latches;

(d) a second connector part having at least two spaced catches, each catch shaped to engage in latching engagement one of the barbs on the first connector part when the first connector part is fully inserted in the second connector part; and (e) a section extending from the first connector body toward the flexible linking bar, the section limiting deflection of the linking bar toward the first connector body;

wherein a force applied to the flexible linking bar on the first connector part in a direction away from the second connector part deforms the flexible linking bar, pivots the latches, displaces the barbs away from the catches, and disengages the latching engagement of the first and second connector parts.

9. The connector assembly according to claim 8 wherein the latches are flexible.

10. The connector assembly according to claim 9 wherein the flexible latches each comprise a short flexible tab, the tabs pivotally attaching the latches on the body of the first connector part.

11. The connector assembly according to claim 8 wherein the first connector part is adapted to be mounted on a cable.

12. The connector assembly according to claim 11 wherein the second connector part is adapted to be mounted on a printed circuit board.

13. The connector assembly according to claim 8 wherein the flexible linking bar further comprises a handle.

14. The connector assembly according to claim 8 wherein the linking bar connecting the latches is shaped as an arc bending away from the body of the first connector part.

15. A connector assembly comprising:

a first connector part adapted to be mounted on a cable and having:

(a) a body, (b) at least two spaced flexible latches each having a first end defining a barb and a second end, each latch pivotally mounted on the body at a point intermediate the first and second ends, (c) a flexible linking bar extending between the second ends of the latches and including a handle; and (d) a section extending from the body toward the flexible linking bar, the section limiting deflection of the linking bar toward the body; and a second connector part adapted to be mounted on a printed circuit board and having at least two spaced catches, each catch shaped to engage in latching engagement one of the barbs on the first connector part when the first connector part is fully inserted in the second connector part;

wherein a force applied to the flexible linking bar on the first connector part in a direction away from the second connector part deforms the flexible linking bar, pivots the latches, displaces the barbs away from the catches, and disengages the latching engagement of the first and second connector parts.

* * * * *